US006930454B2

(12) United States Patent
Lott

(10) Patent No.: US 6,930,454 B2
(45) Date of Patent: Aug. 16, 2005

(54) METHOD FOR OPERATING AT LEAST ONE LOW-PRESSURE DISCHARGE LAMP AND OPERATING DEVICE FOR AT LEAST ONE LOW-PRESSURE DISCHARGE LAMP

(75) Inventor: Jörg Lott, Chieming (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/713,004

(22) Filed: Nov. 17, 2003

(65) Prior Publication Data

US 2004/0104691 A1 Jun. 3, 2004

(30) Foreign Application Priority Data

Nov. 28, 2002 (DE) ..... 102 55 737

(51) Int. Cl.[7] ..... G05F 1/00
(52) U.S. Cl. ..... 315/308; 315/224; 315/DIG. 7
(58) Field of Search ..... 315/200 R, 205, 315/209 R, 224–226, 246, 291, 307–308, DIG. 5, DIG. 7

(56) References Cited

U.S. PATENT DOCUMENTS 5,583,399 A * 12/1996 Rudolph ..... 315/291
5,808,422 A 9/1998 Venkitasubrahmanian et al. ..... 315/225
6,011,358 A * 1/2000 Knobloch et al. ..... 315/224
6,043,612 A * 3/2000 Knobloch et al. ..... 315/224
6,198,231 B1 3/2001 Schemmel et al. ..... 315/225
6,291,944 B1 9/2001 Hesterman et al. ..... 315/224

FOREIGN PATENT DOCUMENTS

DE 197 08 792 A1 9/1998 ..... H05B/41/29
EP 0 886 460 A1 12/1998 ..... H05B/41/28
EP 1 003 357 A1 5/2000 ..... H05B/41/292
WO 99/56506 11/1999

OTHER PUBLICATIONS

European Patent Office Search Report (referencing all documents listed above) dated Mar. 29, 2004.

* cited by examiner

*Primary Examiner*—Thuy Vinh Tran

(57) ABSTRACT

The invention relates to a method for operating at least one low-pressure discharge lamp using an inverter (T1, T2), the occurrence of a rectifier effect in the at least one low-pressure discharge lamp (FL1, FL2) being monitored during the operation of the at least one low-pressure discharge lamp (FL1, FL2) in order to determine the end of its life. For the purpose of monitoring the rectifier effect of the at least one low-pressure discharge lamp (FL1, FL2), the electric power (P) fed into the inverter (T1, T2), the d.c. voltage drop ($U_{dc1}$, $U_{dc2}$) across the electric connections of the at least one low-pressure discharge lamp (FL1, FL2) and the r.m.s. value ($U_{ac}$) of the a.c. voltage component of the running voltage of the at least one low-pressure discharge lamp (FL1, FL2) are evaluated.

9 Claims, 2 Drawing Sheets

Figure 1:
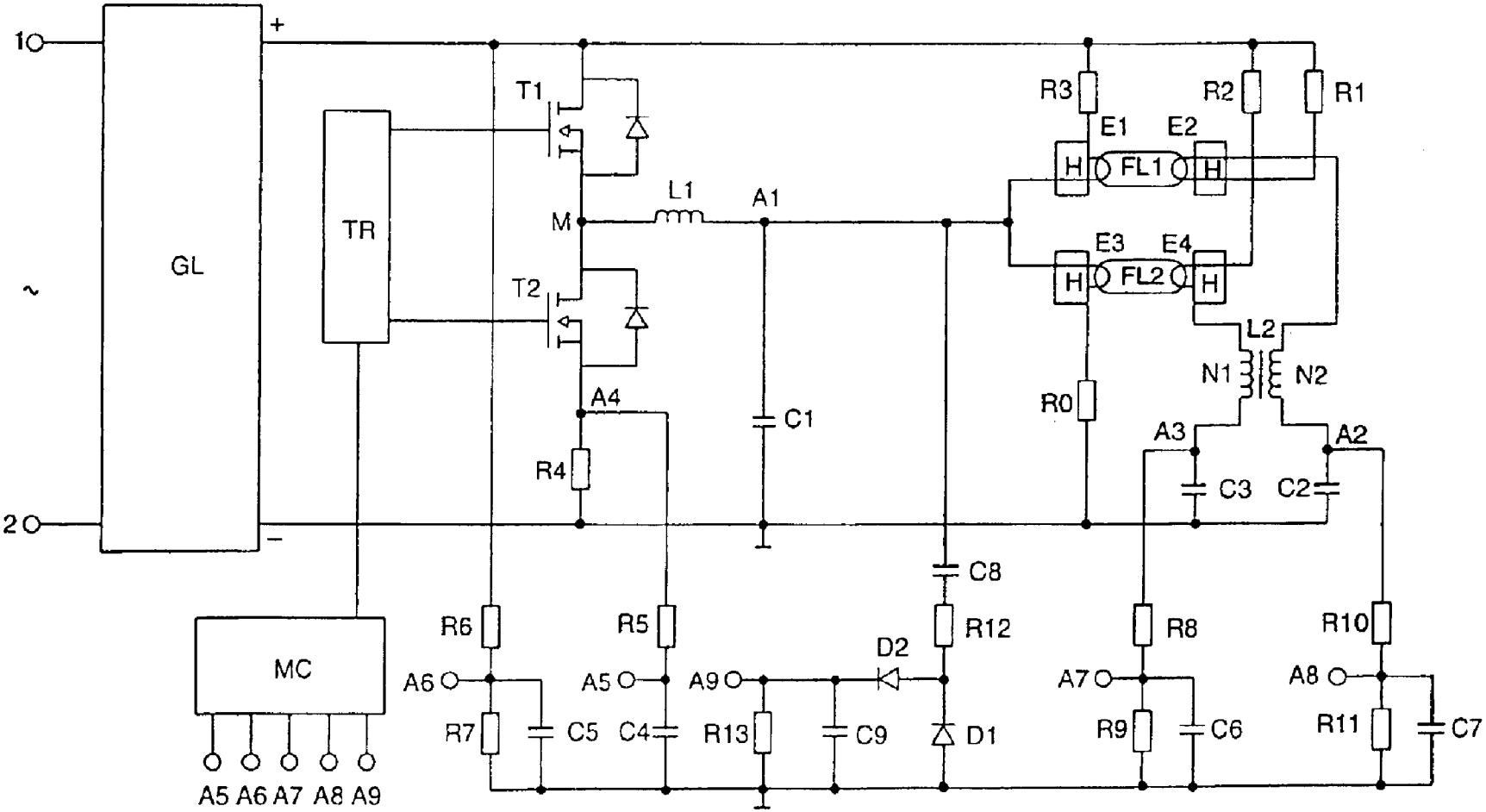

METHOD FOR OPERATING AT LEAST ONE LOW-PRESSURE DISCHARGE LAMP AND OPERATING DEVICE FOR AT LEAST ONE LOW-PRESSURE DISCHARGE LAMP

I. TECHNICAL FIELD

The invention relates to a method for operating at least one low-pressure discharge lamp using an inverter, wherein the occurrence of a rectifier effect in the at least one low-pressure discharge lamp is being monitored during the operation of said at least one low-pressure discharge lamp in order to determine the end of its life.

In addition, the invention relates to an operating device for at least one low-pressure discharge lamp for carrying out the method of operation mentioned above.

II. BACKGROUND ART

An operating method of this type is disclosed, for example, in the international patent application having the publication number WO 99/56506. This publication describes the operation of a low-pressure discharge lamp using a circuit arrangement which has a half-bridge inverter having a load circuit connected to it in which the connections for the lamp are arranged. In order to detect the occurrence of the rectifier effect in the low-pressure discharge lamp, the voltage drop across the half-bridge capacitor is monitored and, when a predetermined upper limit value is exceeded or a predetermined lower limit value is undershot, a shutdown apparatus is activated for the half-bridge rectifier.

III. DISCLOSURE OF THE INVENTION

The object of the invention is to provide an operating method for at least one low-pressure discharge lamp which makes it possible to reliably identify the rectifier effect in the at least one low-pressure discharge lamp, and in particular avoids shutdowns of the operating device owing to erroneous identification of the rectifier effect. In addition, the object of the invention is to provide an operating device for at least one low-pressure discharge lamp for carrying out this method.

This object is achieved by a method for operating at least one low-pressure discharge lamp using an inverter, wherein the occurrence of a rectifier effect in said at least one low-pressure discharge lamp is being monitored during the operation of the at least one low-pressure discharge lamp in order to determine the end of its life, and wherein for the purpose of monitoring said rectifier effect of the at least one low-pressure discharge lamp, the d.c. voltage drop across the electric connections of the said least one low-pressure discharge lamp, the electric power fed into said inverter, or a first variable which is proportional thereto, and a second variable correlated with the running voltage of the said at least one low-pressure discharge lamp are evaluated.

The method according to the invention for operating at least one low-pressure discharge lamp using an inverter is distinguished by the fact that, for the purpose of monitoring the occurrence of the rectifier effect in the at least one low-pressure discharge lamp, the d.c. voltage drop across the electric connections of the at least one low-pressure discharge lamp, the electric power fed into the inverter, or a first variable which is proportional thereto, and a second variable correlated with the running voltage of the at least one low-pressure discharge lamp are evaluated in order to define therefrom a criterion for the presence of the rectifier effect in the at least one low-pressure discharge lamp and thus also a criterion for the at least one low-pressure discharge lamp coming to the end of its life. By monitoring and evaluating the abovementioned three variables, the occurrence of the rectifier effect can be determined with sufficient accuracy independently of the lamp used and the dimming setting at that time. The method according to the invention increases the reliability of the system comprising the at least one low-pressure discharge lamp and the operating device, since the tolerance range for determining the end of life of the at least one low-pressure discharge lamp can be specified more accurately by means of the three abovementioned variables, and, in this manner, a shutdown of the operating device owing to an erroneous detection of the rectifier effect is avoided.

The second variable correlated with the running voltage of the at least one low-pressure discharge lamp is advantageously the r.m.s. value of the a.c. voltage component of the running voltage of the at least one low-pressure discharge lamp. Instead, however, this second variable may also be a constant value which corresponds to the average value of the running voltage which is characteristic of the lamp type of the at least one low-pressure discharge lamp. For a T5 fluorescent lamp having a power consumption of 80 watts, the abovementioned average value is, for example, 145 V, and for a T5 fluorescent lamp having a power consumption of 54 watts, the abovementioned average value is, for example, 118 V. In place of the electric power fed into the inverter, a variable which is proportional thereto can also be evaluated. Suitable for this purpose is, in particular, the effective component of the current flowing through the inverter. Since the inverter is usually supplied with an approximately constant d.c. voltage, the effective component of the current flowing through the inverter is proportional to the electric power fed into the inverter. In order to determine the effective component of the abovementioned current, it is preferable to evaluate the voltage drop across a resistor which, during a switching phase of the inverter, has all of the current of the inverter flowing though it. This voltage drop is likewise proportional to the electric power fed into the inverter.

For the purpose of evaluating the abovementioned variables, the product of the electric power fed into the inverter and the quotient of the d.c. voltage drop across the electric connections of the at least one low-pressure discharge lamp and the second variable correlated with the running voltage of the at least one low-pressure discharge lamp is advantageously compared with a predetermined power value, since this product of the electric power fed into the inverter and the quotient of the abovementioned voltages gives directly a measure of the asymmetry of the emission behavior of the lamp electrodes and the result gives a value for an electric power which can be directly compared with the permissible maximum value which is specified in the supplement to the standard IEC 61347-2-3 "Particular requirements for a.c. supplied electronic ballasts for fluorescent lamps" under Test 2 "Asymmetric Power Dissipation". This maximum value is 7.5 watts for T5 lamps and 5.0 watts for T4 lamps.

In order to avoid a division when evaluating the abovementioned variables, the product of a predetermined power value and the second variable correlated with the running voltage of the at least one low-pressure discharge lamp is preferably compared with the product of the electric power fed into the inverter and the d.c. voltage drop across the electric connections of the at least one low-pressure discharge lamp. The above-cited permissible maximum value of Test 2 "Asymmetric Power Dissipation" from the supplement to the standard IEC 61347-2-3 is used as the predetermined power value. This comparison is then equivalent to the comparison described in the preceding paragraph.

The comparison is continuously repeated throughout the lamp operation using updated values of the three abovementioned variables in order to prevent the lamp electrodes being overheated in the event of the occurrence of the rectifier effect. In order to make it possible to reliably identify the rectifier effect, and thus to prevent an accidental single instance of the permissible maximum value being exceeded leading to a shutdown of the at least one low-pressure discharge lamp, a counter operation is advantageously performed as a function of the result of the comparison and a status bit is set or reset in the event of the counter overflowing. The state of the status bit is thus an indicator of whether the at least one low-pressure discharge lamp has already reached the end of its life.

The evaluation advantageously takes place with the aid of a microcontroller, in which an appropriate program for carrying out the comparisons has been implemented. The microcontroller can additionally also perform the function of controlling the driver circuits for the transistor switches of the inverter.

The electric power fed into the inverter is advantageously determined from the voltage drop across a voltage divider which is arranged in parallel with the input of the inverter, and from the voltage drop across a resistor which is connected in series with an inverter transistor during a switching phase of the inverter and which at the same time has the current of the at least one low-pressure discharge lamp flowing through it. The voltage drop across the abovementioned resistor can also be used to regulate the brightness of the at least one low-pressure discharge lamp. The same measured values can therefore be evaluated, for example with the aid of a microcontroller both for regulating the brightness and for detecting the end of life of the at least one low-pressure discharge lamp.

The operating device according to the invention for at least one low-pressure discharge lamp has the following features:

- a half-bridge inverter, to which is connected a load circuit in which electric connections for at least one low-pressure discharge lamp and at least one half-bridge capacitor are arranged,
- a first measuring apparatus for measuring a first voltage which is proportional to the electric power injected into the half-bridge inverter,
- a second measuring apparatus for measuring a second voltage which is proportional to the voltage drop across the at least one half-bridge capacitor,
- a third measuring apparatus for measuring a third voltage which is proportional to the r.m.s. value of the running voltage of the at least one low-pressure discharge lamp,
- a fourth measuring apparatus for measuring a fourth voltage which is proportional to the supply voltage of the half-bridge inverter,
- an evaluation unit which is connected to the outputs of the measuring apparatuses and comprises a program-controlled microcontroller and which serves the purpose of evaluating the first to fourth voltage as well as of controlling the half-bridge inverter as a function of the result of the evaluation.

The above-described operating device makes it possible to carry out the operating method according to the invention.

IV. BRIEF DESCRIPTION OF THE DRAWINGS

Figure 2:
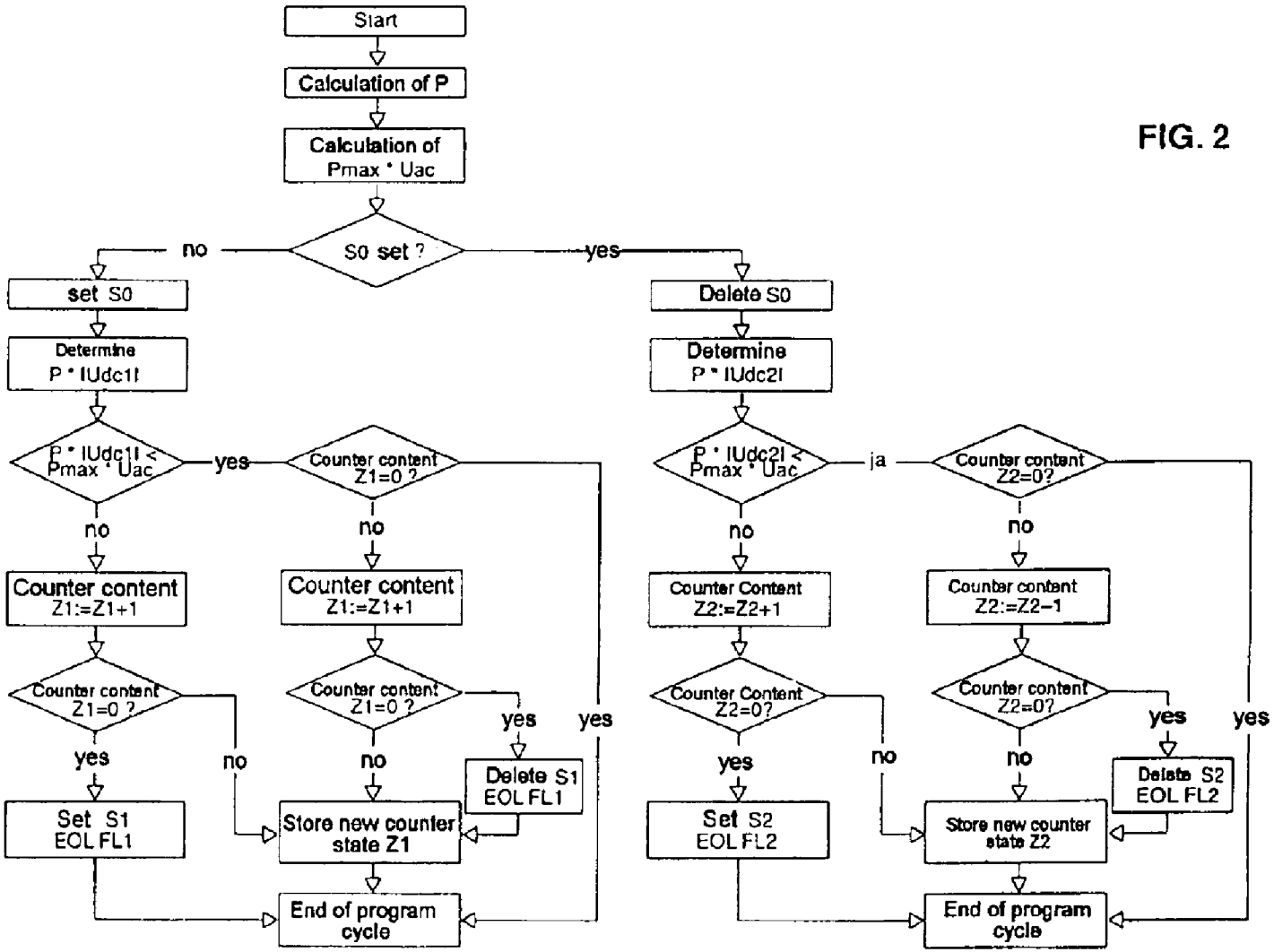

The invention is explained in more detail below with reference to a preferred embodiment. In the drawings:

FIG. 1 shows a schematic sketched circuit diagram of the circuit arrangement of the operating device according to the invention for carrying out the operating method according to the invention, and FIG. 2 shows a flow chart of the operating method according to the invention.

V. BEST MODE FOR CARRYING OUT THE INVENTION

The operating device according to the invention depicted schematically in FIG. 1 is an electronic ballast for operating two low-pressure discharge lamps, in particular T5 fluorescent lamps FL1, FL2, which are connected in parallel. This ballast makes it possible, in particular, also to regulate the brightness of the fluorescent lamps FL1, FL2.

The ballast has two mains voltage connections 1, 2 and a mains voltage rectifier GL which is connected downstream, also comprises a filter circuit and, if appropriate, a step-up converter and at whose voltage output the supply voltage for the downstream half-bridge inverter is provided. The half-bridge inverter has two half-bridge transistors T1, T2, to whose center tap M a load circuit is connected which is in the form of a series resonant circuit and comprises the resonance inductor L1 and the resonance capacitor C1. Arranged in parallel with the resonance capacitor C1 is a parallel circuit comprising two fluorescent lamps FL1, FL2. This parallel circuit has two half-bridge capacitors C2, C3 which are each arranged in series with one of the fluorescent lamps FL1 and FL2, respectively. In addition, a winding N1 and N2, respectively, of a balancing transformer L2, which serves the purpose of balancing the lamp currents in the two branches, is connected in each branch of the parallel circuit. The connection A2, which is at a high potential, of the first half-bridge capacitor C2 is connected to the positive d.c. voltage output of the mains voltage rectifier GL via the winding N2 of the transformer L2, the electrode E2 of the first fluorescent lamp FL1 and the resistor R1. Similarly, the connection A3, which is at a high potential, of the second half-bridge capacitor C3 is connected to the positive d.c. voltage output of the mains voltage rectifier GL via the winding N1 of the transformer L2, the electrode E4 of the second fluorescent lamp FL2 and the resistor R2. The connections, which are at a low potential, of the half-bridge capacitors C2, C3 are each connected to the negative d.c. voltage output of the mains voltage rectifier GL and the ground potential. The connection A1 of the resonance capacitor C1 is connected to the electrode E1 of the first fluorescent lamp FL1 and the electrode E3 of the second fluorescent lamp and is connected to the center tap M of the half-bridge inverter via the resonance inductor L1. The other connection of the resonance capacitor C1 is connected to the negative d.c. voltage output of the mains voltage rectifier GL and the ground potential. In addition, the connection A1 is connected to the positive d.c. voltage output of the mains voltage rectifier GL via the electrode E1 and the resistor R3. The heating apparatus H depicted only schematically in FIG. 1 is inductively coupled to all of the electrodes E1, E2, E3, E4 of the two fluorescent lamps FL1, FL2 and serves the purpose of heating the lamp electrodes prior to the gas discharge being started or else during dimmed operation of the lamps. Details of this heating apparatus H are described, for example, in the laid-open specification EP 0 748 146 A1. The resistors R0, R1, R2 and R3 serve the purpose of setting the potentials at the taps A1, A2 and A3. The corresponding electric voltages can build up across the capacitors C1, C2 and C3, in particular by means of the abovementioned resistors directly after the operating device is switched on and prior to the gas discharge being started in the lamps FL1, FL2.

The half-bridge transistors T1, T2 are controlled with the aid of the program-controlled microcontroller MC and the driver circuits TR for the transistors T1, T2. By alternate switching of the transistors T1, T2, the center tap M is connected alternately to the negative and the positive d.c. voltage output of the mains voltage rectifier GL. Since the half-bridge capacitors C2, C3 are charged to half the supply voltage of the half-bridge inverter, a radio-frequency alternating current, whose frequency is determined by the switching cycle of the transistors T1, T2, flows between the taps M and A2 or A3 during-lamp operation. For the purpose of starting the gas discharge in the fluorescent lamps FL1, FL2, the switching cycle of the half-bridge transistors T1, T2 is altered such that the frequency of the alternating current in the load circuit is close to the resonant frequency of the series resonant circuit L1, C1. By this means, a sufficiently high voltage is generated across the resonance capacitor C1 in order to start the gas discharge in the fluorescent lamps FL1, FL2. Once the gas discharge has been started in the fluorescent lamps FL1, FL2, the series resonant circuit L1, C1 is damped by the parallel circuit of the fluorescent lamps FL1, FL2. The brightness of the fluorescent lamps FL1, FL2 is likewise regulated by altering the frequency of the alternating current in the load circuit and in the parallel circuit of the fluorescent lamps FL1, FL2. For the purpose of regulating the brightness or the power of the fluorescent lamps FL1, FL2, the resistor R4 is arranged in series with the half-bridge transistor T2 such that its connection A4 can be connected to the center tap M via the switching path of the transistor T2, and its other connection is connected to the ground potential and to the negative d.c. voltage output of the mains voltage rectifier GL. Whilst the half-bridge transistor T2 is conductive, all of the current of the load circuit and of the parallel circuit of the fluorescent lamps FL1, FL2 therefore flows through the resistor R4. At the connection A4, the voltage drop across the resistor R4 is measured with the aid of the low-pass filter R5, C4 which is connected to said connection A4. The voltage drop U1 at the center tap A5 of the low-pass filter R5, C4, which is proportional to the effective component of the current through the half-bridge inverter transistor T2, is fed to the corresponding connection A5 of the microcontroller MC for the purpose of evaluating and, in particular, also regulating the brightness of the fluorescent lamps FL1, FL2 Arranged in parallel with the d.c. voltage output of the mains voltage rectifier GL is the voltage divider R6, R7 with the capacitor C5 connected in parallel with the resistor R7. At the tap A6 between the resistors R6, R7, which is connected to the corresponding connection A6 of the microcontroller MC, the voltage U2 is measured which is proportional to the supply voltage of the half-bridge inverter. Arranged in parallel with the half-bridge capacitor C3 is the voltage divider R8, R9 with the capacitor C6 connected in parallel with the resistor R9. At the tap A7 between the resistors R8, R9, which is connected to the corresponding connection A7 of the microcontroller MC, the voltage U3 is measured which is proportional to the voltage drop across the half-bridge capacitor C3. Similarly, arranged in parallel with the half-bridge capacitor C2 is the voltage divider R10, R11 with the capacitor C7 connected in parallel with the resistor R11. At the tap A8 between the resistors R10, R11, which is connected to the corresponding connection A8 of the microcontroller MC, the voltage U4 is measured which is proportional to the voltage drop across the half-bridge capacitor C2. The connection A1 of the resonance capacitor C1 is connected to the ground potential via the capacitor C8, the resistor R12 and the reverse-biased diode D1. A tap between the resistor R12 and the cathode of the diode D1 is connected to the ground potential via the forward-biased diode D2 and the resistor R13. Connected in parallel with the resistor R13 is the capacitor C9. The connection A9, which is connected to the cathode of the diode D2, of the resistor R13 is connected to the corresponding connection A9 of the microcontroller MC. At the connection A9, the voltage U5 is measured which is proportional to a good approximation to the r.m.s. value of the a.c. voltage component of the running voltage of the fluorescent lamps FL1, FL2, which are connected in parallel.

The voltages U1 to U5 at the connections A5, A6, A7, A8 and A9 are converted into digital values by means of analogue-to-digital converters and evaluated by the microcontroller MC with the aid of a program implemented in the microcontroller in order to ensure that the brightness of the fluorescent lamps FL1, FL2 is regulated and the end of life of the lamps FL1, FL2 is identified by means of the driver circuit TR by appropriately controlling the half-bridge transistors T1, T2. The end of life of the lamps FL1, FL2 is determined by monitoring the occurrence of the rectifier effect in the fluorescent lamps FL1, FL2 For this purpose, the electric power P fed into the half-bridge inverter, the d.c. voltage drop $U_{dc1}$ or $U_{dc2}$ across the electric connections of the fluorescent lamps FL1, FL2 and the r.m.s. value $U_{ac}$ of the a.c. voltage component of the running voltage of the fluorescent lamps FL1, FL2, which are connected in parallel, are evaluated by means of the microcontroller MC. The electric power P fed into the half-bridge inverter is proportional to the product of the voltages at the connections A5 and A6. It is calculated from the voltages U1 and U2 as:

$$P = U1 \cdot U2 \cdot \frac{R6 + R7}{R4 \cdot R7} \tag{1}$$

The d.c. voltage drop $U_{dc1}$ across the electric connections of the fluorescent lamp FL1 can be calculated from the difference between half the supply voltage of the half-bridge inverter and the voltage drop across the half-bridge capacitor C2 and can therefore be determined from the voltages U2 and U4.

$$U_{dc1} = \frac{1}{2} \cdot U2 \cdot \frac{R6 + R7}{R7} - U4 \cdot \frac{R10 + R11}{R11} \tag{2}$$

Similarly, the d.c. voltage drop $U_{dc2}$ across the electric connections of the fluorescent lamp FL2 is calculated from the difference between half the supply voltage of the half-bridge inverter and the voltage drop across the half-bridge capacitor C3 and can therefore be determined from the voltages U2 and U3.

$$U_{dc2} = \frac{1}{2} \cdot U2 \cdot \frac{R6 + R7}{R7} - U3 \cdot \frac{R8 + R9}{R9} \tag{3}$$

The r.m.s. value $U_{ac}$ of the a.c. voltage component of the running voltage of the fluorescent lamps FL1, FL2, which are connected in parallel, is calculated with sufficient accuracy from the voltage U5 measured at the connection A9 as:

$$U_{ac} = 2 \cdot k \cdot U5 \cdot \frac{R12 + R13}{R13} \quad (4)$$

The constant k is the form factor of the voltage U5. For a square-wave voltage it has the value 1 and for a sinusoidal voltage it has the value 1.11. Using the variables above, P, $U_{ac}$ and $U_{dc1}$ or $U_{dc2}$, the power P1 or P2 can be calculated for the two fluorescent lamps FL1 and FL2 using the formula $$P1 = P \cdot \frac{|U_{dc1}|}{U_{ac}} \text{ or } P2 = P \cdot \frac{|U_{dc2}|}{U_{ac}} \quad (5a), (5b)$$

The values of the powers P1 and P2 can be compared directly with the maximum permissible limit value $P_{max}$ of 7.5 watts for the lamp power for T5 lamps, given in "Test 2: Asymmetric Power Dissipation" of the supplement to the standard IEC 61347-2-3, in order to monitor the end of life for the two fluorescent lamps FL1, FL2

In order that the microcontroller MC does not need to perform any division, for the purpose of monitoring the end of life for the fluorescent lamps FL1, FL2 cyclic checks are made during lamp operation to determine whether the following condition is met:

$$P \cdot |U_{dc1}| < P_{max} \cdot U_{ac} \text{ or } P \cdot |U_{dc2}| < P_{max} \cdot U_{ac} \quad (6a), (6b)$$

The method for monitoring the end of life for the two T5 fluorescent lamps FL1, FL2 is explained in more detail below with reference to the flow chart depicted in FIG. 2.

At the beginning of the cyclically converted method, the electric power consumption P of the half-bridge inverter is determined by means of the program implemented in the microcontroller MC from the measured values U1 and U2, which are updated during each cycle of the method, using the formula (1). Then, the product $P_{max} \cdot U_{ac}$ is calculated from the measured value U5, which is likewise updated during each cycle of the method, using the formula (4). Subsequently, the state of the status bit S0 is checked which indicates whether the lamp FL1 has been checked during the cycle most recently completed in order, in this case, then to continue with the check on the lamp FL2. If the status bit S0 is not set, i.e. the lamp FL1 was not checked during the cycle most recently completed, the status bit S0 is set and then the d.c. voltage component across the connections of the lamp FL1 is determined, using the formula (2), from the measured values of the voltages U2 and U4, which are updated during each cycle of the method, and the product of the absolute value of this d.c. voltage component $U_{dc1}$ and the power consumption P of the half-bridge inverter is formed using the formula (6a) . Subsequently, a check is made to determine whether the condition (6a) is met, i.e. whether the value of the product $P \cdot |U_{dc1}|$ is smaller than the value of the product $P_{max} \cdot U_{ac}$.

If this condition (6a) is not met, the counter content Z1 of a first counter is increased by the value 1. Then a check is made to determine whether the counter content Z1 of the first counter has the value zero and thus the counter has overflowed, which occurs with the value 256. If this is the case, the status bit S1 is set, which indicates the end of life of the lamp FL1, and the current cycle of the method is complete. If the counter content Z1 of the first counter is greater than zero, the current counter content Z1 is stored and the current cycle is abandoned.

If the condition (6a) is met, a check is made to determine whether the counter content Z1 is zero and, in this case, the current cycle is abandoned. If the counter content Z1 was greater than zero, the counter content Z1 is lowered by one and then a further check is made to determine whether it is still greater than zero. If the counter content is now equal to zero, the status bit S1, which indicates the occurrence of the end of life of the lamp FL1, is deleted or reset and the counter content Z1 is stored. Otherwise, only the counter content Z1 is stored. Then, in both cases, the current cycle is abandoned.

The other fluorescent lamp FL2 is monitored in an identical manner. If, during the most recent cycle of the monitoring method, the fluorescent lamp FL1 was checked, the status bit S0 is set, and the program or the algorithm splits into the branch for monitoring the lamp FL2 as shown in the flow chart of FIG. 2.

If the status bit S0 is set, i.e. the lamp FL1 was checked during the cycle most recently completed the status bit S0 is reset and then the d.c. voltage component across the connections of the lamp FL2 is determined, using the formula (2), from the measured values of the voltages U2 and U3, which are updated during each cycle of the method, and the product of the absolute value of this d.c. voltage component $U_{dc2}$ and the power consumption P of the half-bridge inverter is formed using the formula (6b). Subsequently, a check is made to determine whether the condition (6b) is met, i.e. whether the value of the product $P \cdot |U_{dc2}|$ is smaller than the value of the product $P_{max} \cdot U_{ac}$.

If this condition (6b) is not met, the counter content Z2 of a second counter is increased by the value 1. Then a check is made to determine whether the counter content Z2 of the second counter has the value zero and thus the counter has overflowed, which occurs with the value 256. If this is the case, the status bit S2 is set, which indicates the end of life of the lamp FL2, and the current cycle of the method is complete. If the counter content Z2 of the second counter is greater than zero, the current counter content Z2 is stored and the current cycle is abandoned.

If the condition (6b) is met, a check is made to determine whether the counter content Z2 is zero, and, in this case, the current cycle is abandoned. If the counter content Z2 was greater than zero, the counter content Z2 is lowered by one and then a further check is made to determine whether it is still greater than zero. If the counter content is now equal to zero, the status bit S2, which indicates the occurrence of the end of life of the lamp FL2, is deleted and/or reset, and the counter content Z2 is stored. Otherwise, only the counter content Z2 is stored. Then, in both cases, the current cycle is abandoned.

If the status bit S1 or the status bit S2 remains in the set state for longer than a predetermined time interval, i.e., for example, for a predetermined number of sequential monitoring cycles, the operating device is shut down.

The invention is not limited to the exemplary embodiment explained in detail above. For example, the lamps FL1, FL2 can be interrogated in the same cycle as opposed to alternately. Furthermore, the counter contents Z1, Z2 can be increased or lowered by more than 1 if the permissible limit value is greatly exceeded or undershot. In addition, other evaluation methods may also be used. For example, instead of the conditions (6a, 6b), the difference $P \cdot |U_{dc1}| - P_{max} \cdot U_{ac}$ or $P \cdot |U_{dc2}| - P_{max} \cdot U_{ac}$ can be formed and evaluated for the two lamps FL1, FL2. In particular, the values for the abovementioned difference can be added together at different points in time during the lamp operation by means of integrators in order to monitor whether the predetermined upper or lower limit values are being exceeded or undershot. Instead of the operating device or the lamps FL1, FL2 being shut down when the permissible maximum limit value is exceeded, it is also possible to operate the lamps FL1, FL2 at a considerably reduced power until the permissible limit value is undershot again on a permanent basis.

What is claimed is:

1. A method for operating at least one low-pressure discharge lamp using an inverter, an occurrence of a rectifier effect in said at least one low-pressure discharge lamp being monitored during the operation of the at least one low-pressure discharge lamp in order to determine the end of its life, wherein for a purpose of monitoring said rectifier effect of the at least one low-pressure discharge lamp, a d.c. voltage drop across electric connections of said at least one low-pressure discharge lamp, an electric power fed into said inverter, or a first variable which is proportional thereto, and a second variable correlated with a running voltage of said at least one low-pressure discharge lamp are evaluated, wherein said second variable correlated with the running voltage of said at least one low-pressure discharge lamp is one of: (i) an r.m.s. value of an a.c. voltage component of the running voltage of said at least one low-pressure discharge lamp; and (ii) a constant value which corresponds to an average value of said running voltage which is characteristic of a lamp type of said at least one low-pressure discharge lamp.

2. The method as claimed in claim 1, wherein a product of the electric power fed into said inverter and a quotient of the d.c. voltage drop across the electric connections of said at least one low-pressure discharge lamp and the second variable correlated with the running voltage of the at least one low-pressure discharge lamp is compared with a predetermined power value.

3. The method as claimed in claim 2, wherein the comparison is cyclically repeated during the lamp operation.

4. The method as claimed in claim 3, wherein a counter operation is performed as a function of a result of the comparison and a status bit is set or reset in the event of the counter overflowing.

5. The method as claimed in claim 1, wherein a product of a predetermined power value and said second variable correlated with the running voltage of said at least one low-pressure discharge lamp is compared with a product of the electric power fed into said inverter and the d.c. voltage drop across the electric connections of the at least one low-pressure discharge lamp.

6. The method as claimed in claim 1, wherein the values, which are determined at different points in time in the lamp operation, for a difference between a product of the electric power fed into said inverter and of the d.c. voltage drop across the electric connections of the at least one low-pressure discharge lamp and a product of a predetermined power value and of the second variable correlated with the running voltage of the at least one low-pressure discharge lamp are added up and evaluated.

7. The method as claimed in claim 1, wherein the electric power fed into said inverter is determined from a voltage drop across a voltage divider which is arranged in parallel with an input of said inverter, and from a voltage drop across a resistor which is connected in series with an inverter transistor during a switching phase of said inverter and which at the same time has a current of said inverter flowing through it.

8. A method for operating at least one low-pressure discharge lamp using an inverter, an occurrence of a rectifier effect in said at least one low-pressure discharge lamp being monitored during the operation of the at least one low-pressure discharge lamp in order to determine the end of its life, wherein for a purpose of monitoring said rectifier effect of the at least one low-pressure discharge lamp, a d.c. voltage drop across electric connections of said at least one low-pressure discharge lamp, an electric power fed into said inverter, or a first variable which is proportional thereto, and a second variable correlated with a running voltage of said at least one low-pressure discharge lamp are evaluated, wherein the electric power fed into said inverter, the d.c. voltage drop across the electric connections of said at least one low-pressure discharge lamp and a r.m.s. value of an a.c. voltage component of the running voltage of said at least one low-pressure discharge lamp are determined from measured values which are fed to a microcontroller, and a program-controlled evaluation is carried out by the microcontroller.

9. An operating device for at least one low-pressure discharge lamp having a half-bridge inverter, to which is connected a load circuit in which electric connections for said at least one low-pressure discharge lamp and at least one half-bridge capacitor are arranged, a first measuring apparatus for measuring a first voltage which is proportional to an electric power injected into said half-bridge inverter, a second measuring apparatus for measuring a second voltage which is proportional to a voltage drop across said at least one half-bridge capacitor, a third measuring apparatus for measuring a third voltage which is proportional to a r.m.s. value of a running voltage of said at least one low-pressure discharge lamp, a fourth measuring apparatus for measuring a fourth voltage which is proportional to a supply voltage of said half-bridge inverter, an evaluation unit which is connected to the outputs of said measuring apparatuses and comprises a program-controlled microcontroller and which serves a purpose of evaluating said first voltage to said fourth voltage as well as of controlling said half-bridge inverter as a function of a result of the evaluation.

* * * * *